US006471085B1

(12) United States Patent
Gallo

(10) Patent No.: US 6,471,085 B1
(45) Date of Patent: Oct. 29, 2002

(54) TEMPERATURE CUP

(76) Inventor: Anthony J. Gallo, P.O. Box 9193, Marina del Rey, CA (US) 90295

( * ) Notice: Subject to any disclaimer, the term of this patent is extended or adjusted under 35 U.S.C. 154(b) by 136 days.

(21) Appl. No.: 09/678,685

(22) Filed: Oct. 3, 2000

Related U.S. Application Data

(60) Provisional application No. 60/157,564, filed on Oct. 4, 1999.

(51) Int. Cl.[7] ..... A47G 19/22; B65D 21/00

(52) U.S. Cl. ..... 220/501; 206/459.5; 220/23.87; 220/662; 220/703; 220/715; 374/150; 374/157

(58) Field of Search ..... 220/501, 502, 220/23.87, 662, 665, 703, 711, 713, 714, 715; 206/217, 459.5; 222/207; 374/141, 150, 157

(56) References Cited

U.S. PATENT DOCUMENTS 1,841,516 A * 1/1932 Andrews ..... 374/150
5,330,081 A * 7/1994 Davenport ..... 222/207
5,474,206 A * 12/1995 Herring, Sr. ..... 220/636
5,482,373 A * 1/1996 Hutchinson ..... 374/150
5,720,555 A * 2/1998 Elele ..... 374/150
5,823,380 A * 10/1998 Cox ..... 220/502
5,961,004 A * 10/1999 DeMars ..... 220/715
5,964,379 A * 10/1999 DeMars ..... 220/715
6,164,469 A * 12/2000 Sartore ..... 374/141

* cited by examiner

*Primary Examiner*—Stephen P. Garbe
*Assistant Examiner*—Joseph C. Merek
(74) *Attorney, Agent, or Firm*—Gifford, Krass, Groh, Sprinkle, Anderson & Citkowski, P.C.

(57) ABSTRACT

The present invention is directed to a container having a main chamber in fluid communication with a temperature-moderating chamber. Preferably, a valve, actuated by a spring-biased button preferably positioned on a handle of the container, opens and closes an aperture within the temperature-moderating chamber to permit a hot beverage to flow from the main chamber into the temperature-moderating chamber. A lid having a sipping hole is provided to allow the consumer to consume the beverage from the temperature-moderating chamber.

11 Claims, 5 Drawing Sheets

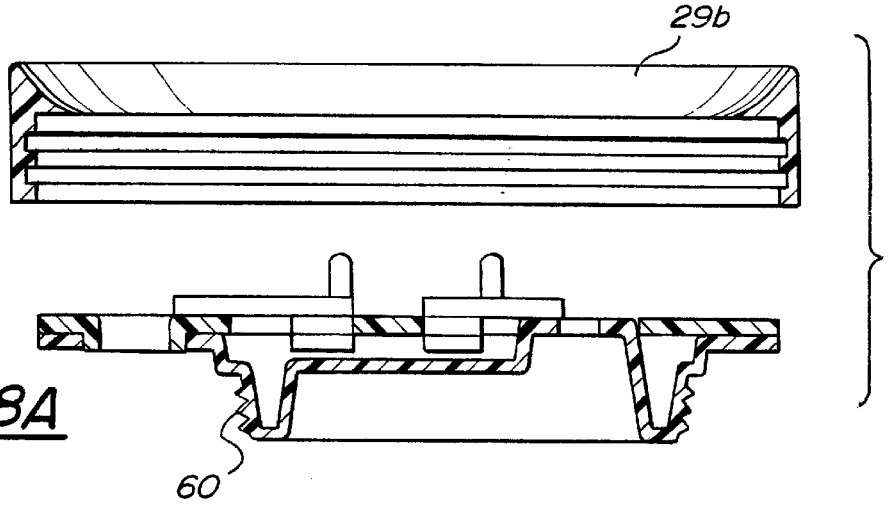
FIG-8A
FIG-8B
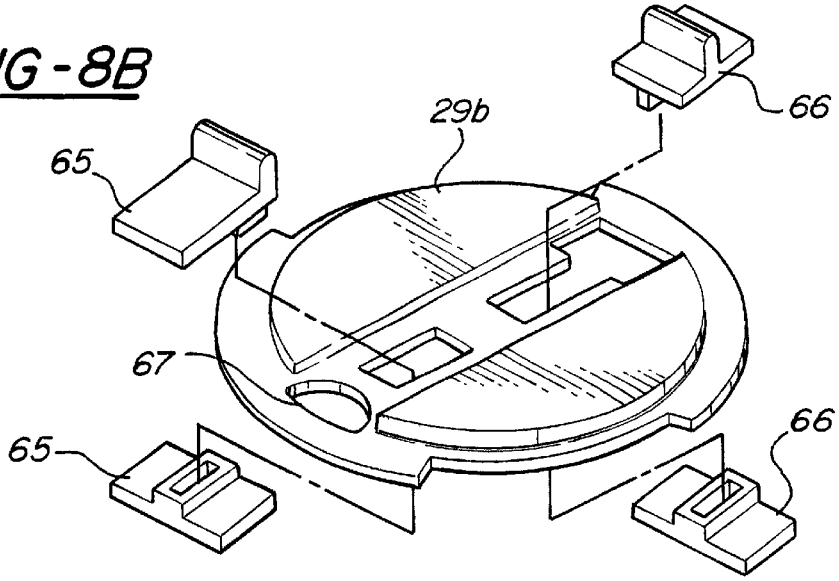
FIG-8C
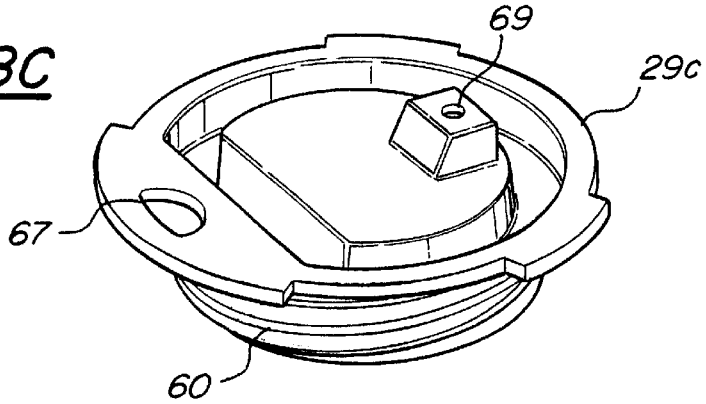

TEMPERATURE CUP

RELATED APPLICATIONS

This application claims the benefit of U.S. Provisional Application Ser. No. 60/157,564 filed Oct. 4, 1999, and is hereby incorporated by reference.

FIELD OF THE INVENTION

The present invention relates to beverage containers and, more particularly, to beverage containers suitable to moderate the temperature of a beverage portion prior to withdrawal from the container.

BACKGROUND OF THE INVENTION

Beverages are often served at a temperature making immediate consumption unpleasant. Hot beverages, such as coffee are maintained at or near the boiling temperature prior to service. A beverage consumed at a temperature of greater than 80° C. has the potential to scald or otherwise damage the mouth and lips of a consumer. Solutions to this problem have included stirring the beverage or waiting for thermal radiation to decrease the beverage temperature to a comfortable level to allow consumption. Additionally, ice or a cooler consumable liquid such as water or milk is added to decrease the beverage temperature. Unfortunately, upon cooling a beverage to a comfortable consumption temperature, the beverage temperature quickly decreases until a hot beverage is below the optimal consumption temperature.

A similar situation exists with cold beverages which have the potential to irritate sensitive dental structures or chill portions of the digestive tract to cause temporary cramps or pain.

With beverage consumption often occurring in transit, opportunities to moderate beverage temperature before consumption are limited. Thus, there exists a need for a beverage container capable of moderating the temperature of a beverage portion within a container while maintaining the majority of the beverage in an extreme temperature state.

SUMMARY OF THE INVENTION

The present invention is directed to a temperature moderating beverage container that includes a temperature moderating chamber that is in fluid communication with a main chamber via an aperture disposed within the moderating chamber. Preferably, a valve assembly including a valve that selectively engages the aperture and a spring bias button for activating the valve. A lid having a sipping aperture disposed thereof may also be provided to assist in sealing the beverage contents within the container. In operation, a user will first fill the main chamber with a hot beverage. Thereafter, the user may depress the button to activate the valve thereby permitting the hot beverage to flow into the temperature-moderating chamber. In the temperature-moderating chamber the hot beverage is permitted to cool to a comfortable temperature at which it may be consumed. It is appreciated by this invention that the container, its main chamber and the temperature-moderating chamber may be formed in a number of configurations. Preferably, the temperature-moderating chamber is formed integrally with the wall of the main chamber. However, the moderating chamber may also take the form of a tube or be constructed as a temperature-moderating body. Where the moderating chamber is shown as a temperature-moderating body is appreciated that the body may include an innerchamber to receive a removable main chamber. Additionally, it is appreciated that the valve and button assembly may be interchanged with a button actuated pump.

BRIEF DESCRIPTION OF THE DRAWINGS

The features and advantages of this invention will be apparent from the following detailed description of a preferred embodiment of an apparatus constructed in accordance with the invention, appended claims and the accompanying drawings wherein like reference numerals refer to like elements and wherein:

FIGS. 8*a–c* are side, exploded and perspective views of a lid constructed in accordance with the present invention.

DETAILED DESCRIPTION OF THE INVENTION

Figure 1:
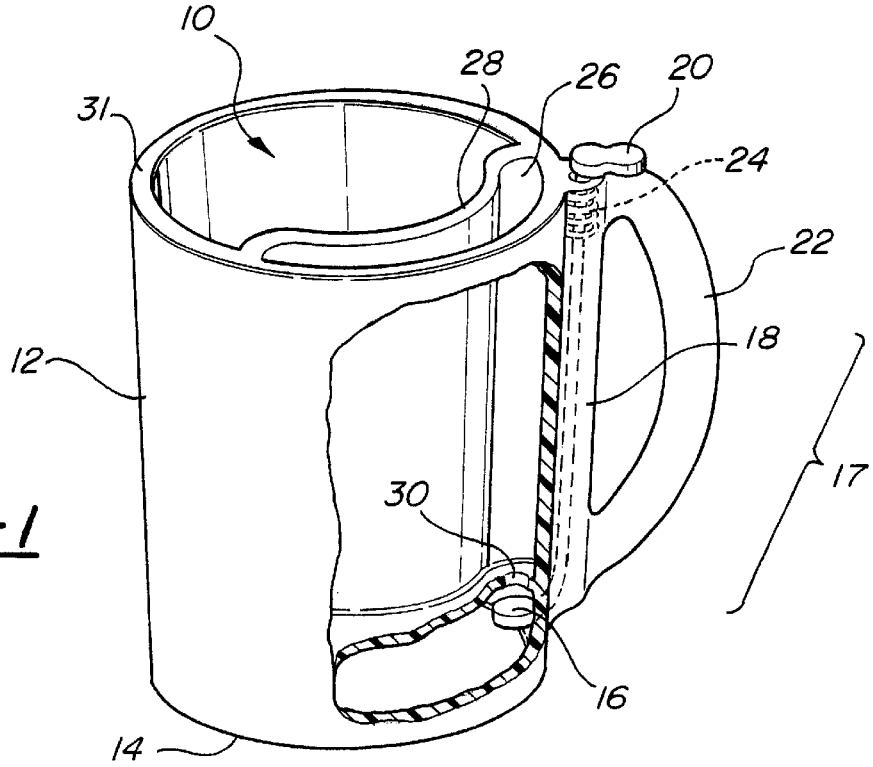
FIG. 1 is a partial cutaway perspective view of an embodiment of the present invention.

Referring now to FIGS. 1–5, and as best shown in FIG. 1, a main chamber 10 contains the largest proportion of a beverage within a container construction in accordance with the present invention. The container is defined by an outer cylindrical wall 12 and a circular base 14. A valve assembly 17 includes a valve 16 having a stem 18 extending beyond the exterior of the cylindrical wall 12 and terminating in a button 20 adapted to be engaged by a human hand grasping the container. The button 20 is situated proximal to a handle 22 extending from the wall 12.

The valve 16 selectively engages, through pressure displacement of the button 20, an aperture 30 formed in a temperature-moderating chamber 26. Preferably, the valve stem 18 engages a coil spring 24 that biases the valve in a closed relationship over the aperture 30. The application of pressure to the button 20 displaces the valve 16. Therefore, the valve 16, upon displacement, controls fluid communication between the main chamber 10 and the temperature-moderating chamber 26.

Preferably, the moderating chamber is integral with the cylindrical outer wall 12 and is defined by a partitioning wall segment 28, as shown in FIG. 1. Alternatively, as discussed below, the chamber 26 may be removably inserted and mounted within the main chamber 10 and, conversely, the main chamber 10 may be removably inserted within the chamber 26.

Figure 2:
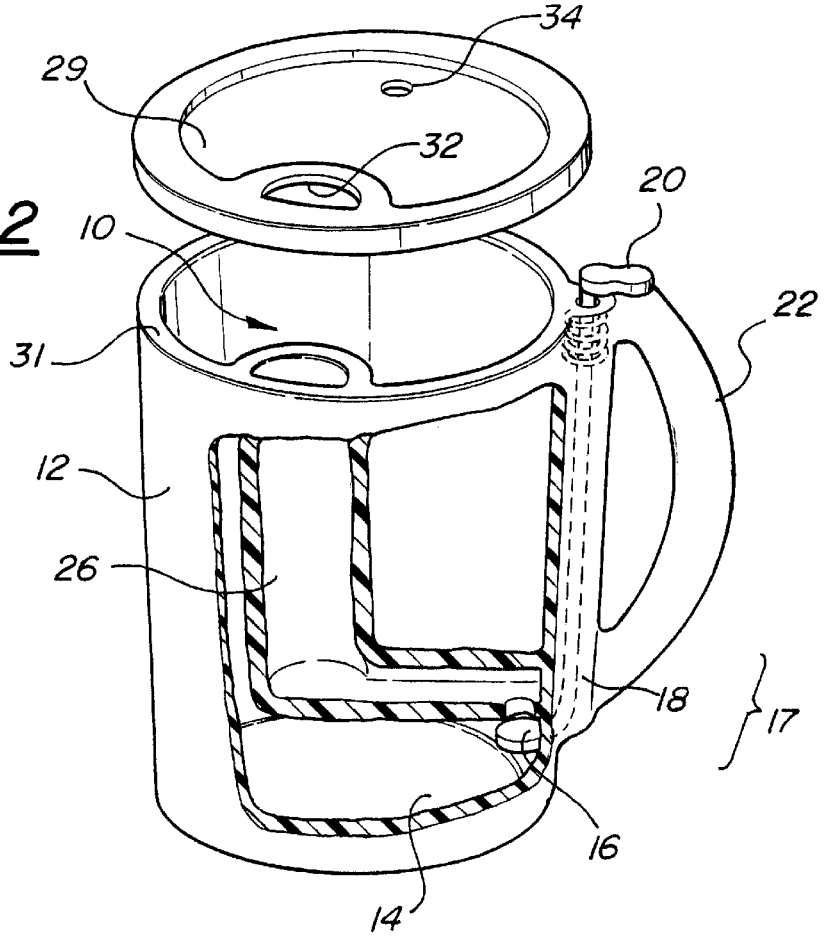
FIG. 2 is a partial cutaway side view of another embodiment of the present invention.
Figure 4:
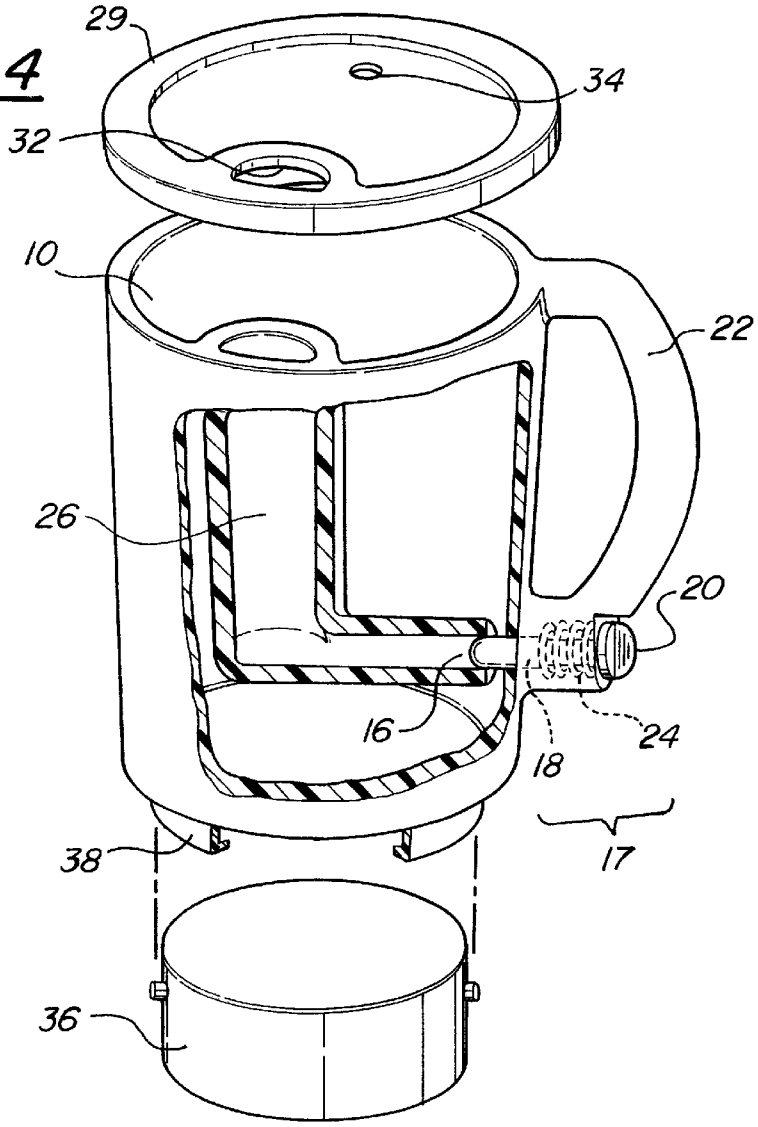
FIG. 4 is a partial cutaway side view of another embodiment of the present invention.
Figure 3:
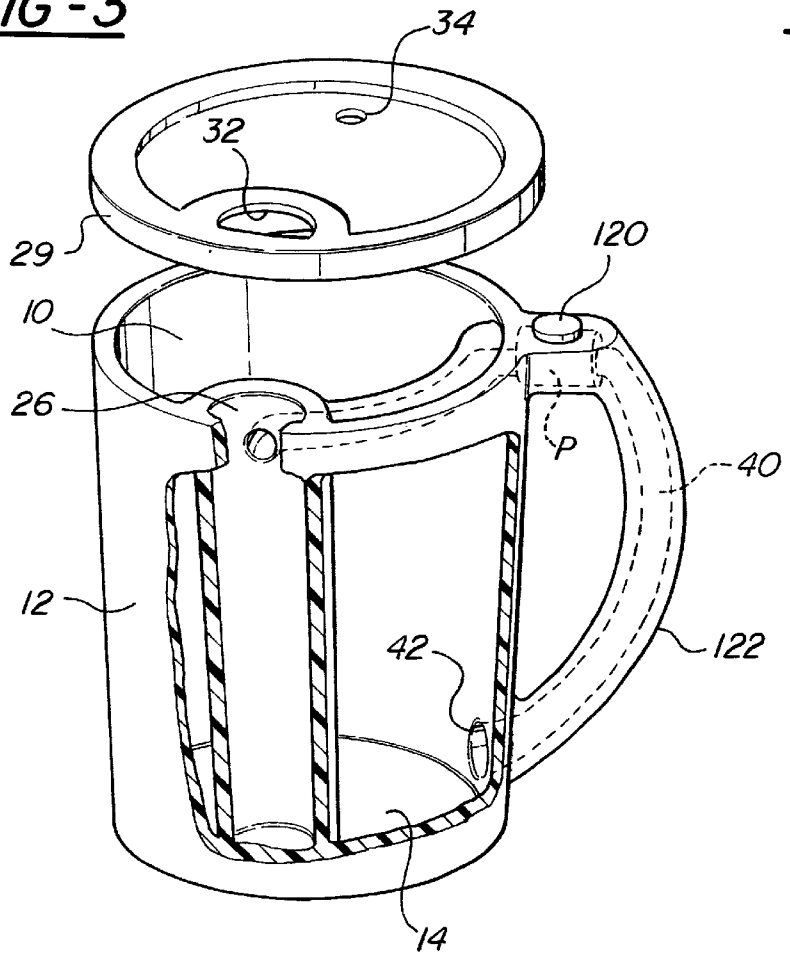
FIG. 3 is a partial cutaway side view of another embodiment of the present invention.

It is appreciated that the shape and dimensions of the temperature-moderating chamber 26 may be modified relative to the position of the handle 22 in order to facilitate ease of consumption and container cleaning. For example, alternatively, the temperature-moderating chamber 26, as shown in the embodiments depicted in FIGS. 2–4, is formed as a generally tubular member. Furthermore, it is preferred that the chamber 26 is of a smaller volume than the main chamber 10. However, it is appreciated that the chamber 26 may also be of equal or greater volume than the main chamber 10.

Optionally, as shown in FIGS. 2–4, a container of the present invention is fitted with a complementary lid 29 adapted to cover the cylindrical wall edge 31. The lid 29 having therein a sipping hole 32 from which beverage is withdrawn from the container and an air hole 34 designed to equilibrate pressures between the interior and exterior of the container.

Preferably, the temperature-moderating chamber 26 is defined by a wall material having insulating properties to diminish thermal conductivity between beverage within the main chamber 10 and the temperature-moderating chamber 26. A temperature-moderating chamber of the present invention is thermally isolated from the main chamber of a container by structures illustratively including a double walled insulated segment, foamed polymeric core materials, and low thermal conductivity polymeric materials. More preferably, the container is molded from a thermoplastic material as a unitary piece with the lid 29, the valve assembly 17, and the spring 20 being separate components.

In an alternative embodiment shown in FIG. 3, the chamber 26 is in fluid communication with the main chamber 10 by way of a side tube 40. The side tube 40 has an opening 42 proximal to the circular base 14 and extends beyond the cylindrical wall 12 to form a handle 122, the side tube 40 top portion terminating within the temperature-moderating chamber 26. The side tube 40 being equipped with a button 120. Upon compression, the button 120 activates a pumping mechanism "P" to draw a beverage from the main chamber 10 into the chamber 26.

Referring now to FIG. 4, in an alternative embodiment a selectively engageable holder 36 engages a mounting fixture 38 extending below the circular base 14. Preferably, the base 36 is adapted to fit within a standard vehicle cup holder.

Figure 5:
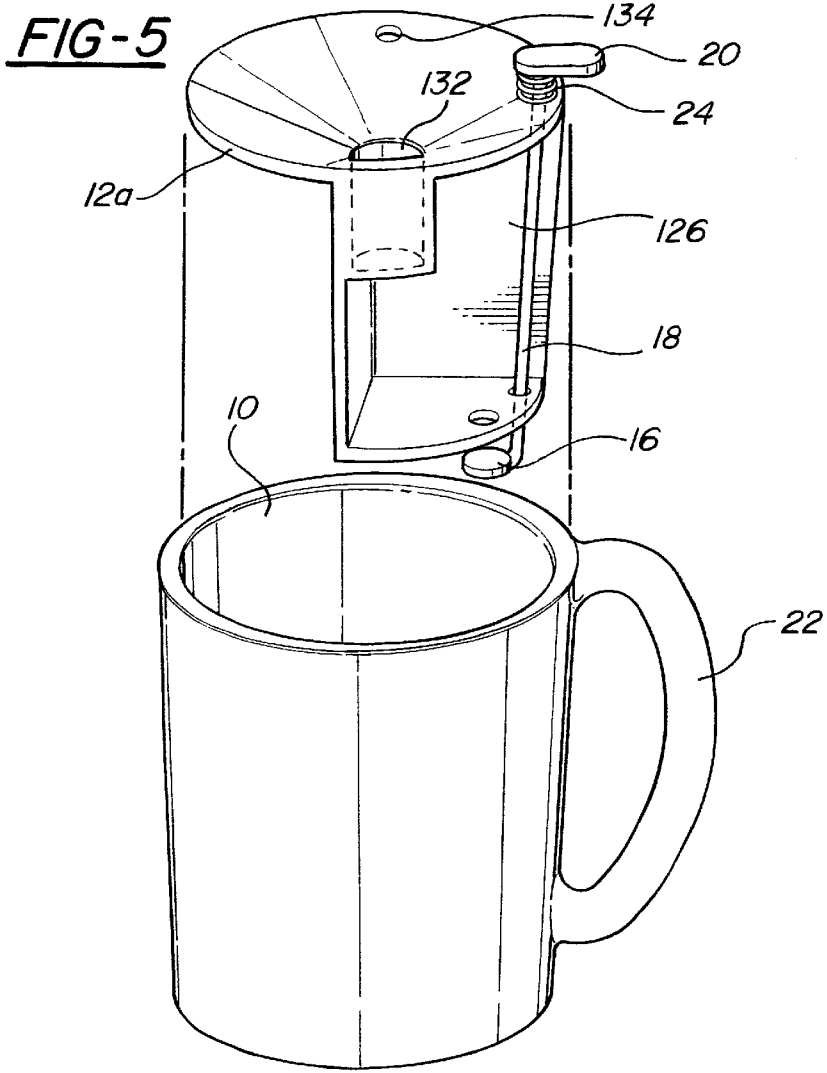
FIG. 5 is a partial cutaway side view of another embodiment of the resent invention.

Referring now to FIG. 5, the temperature-moderating chamber 126 is optionally integrated into a lid 129 having a sipping hole 132 therein and at least one air hole 134. Preferably, both the temperature moderating chamber 126 and the main chamber 10 are in gaseous communication wit air hole 134 to facilitate steady fluid consumption by way of the sipping hole 132.

Figure 6:
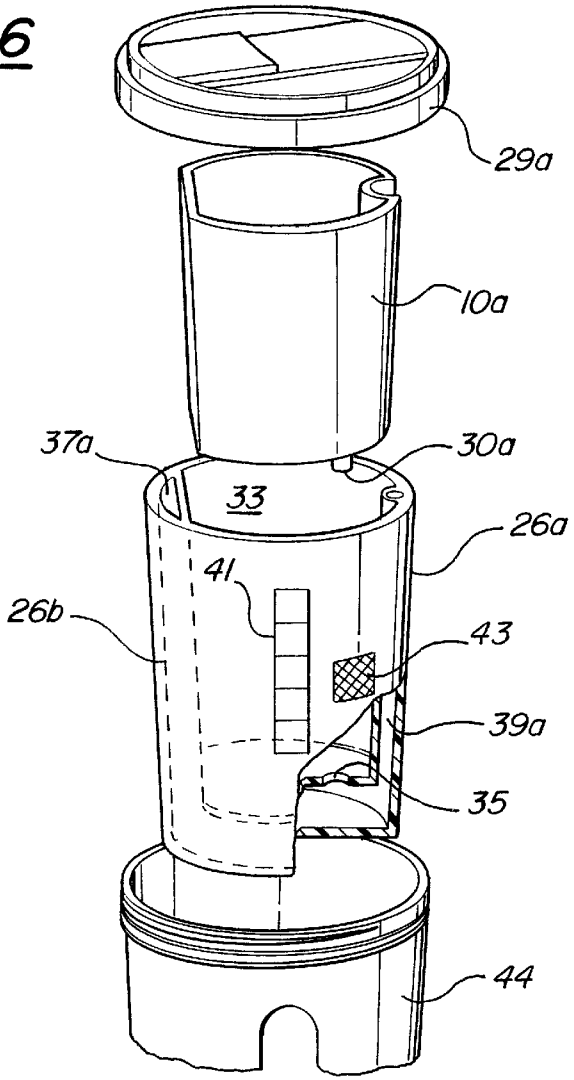
FIG. 6 is a partial cutaway side view of another embodiment of the present invention.

Referring now to FIG. 6, there is shown a further alternative embodiment of the present invention. In this embodiment, the main 10*a* is preferably a generally cylindrical container having an aperture 30*a*. The main chamber 10*a* is removably disposed within a nesting chamber 33 formed in the temperature-moderating body 26*a*. Preferably, the nesting chamber 33 includes an aperture 35 that aligns with the aperture 30*a* (when the main chamber 10*a* is positioned within the nesting chamber 33) to fluidly communicate beverage into the temperature-moderating chamber 26*b*. It is appreciated that the shapes of the nesting chamber 33 and the main chamber 10*a* may be modified (e.g., tapered, alignment grooves) to facilitate proper alignment of the apertures 30*a* and 35. The chamber 26*b* preferably includes a sipping portion 37*a* for use by the consumer and a vent 39*a* to assist in equalizing pressures within the container.

Still referring to FIG. 6, a thermometer 41 is disposed on the exterior of the chamber 26*b* to provide the consumer with information concerning the temperature of the beverage within the container. Preferably, the thermometer is a strip type digital thermometer. However, most any variety of thermometer could be adapted for this function. Additionally, a logo 43 or other indicia may be printed on the body 26*a* to convey an advertising or promotional message.

The main chamber 10*a* and temperature moderating body 26*a* (with chamber 26*b*) are preferably further removably disposed within an insulating cup 44 to provide an additional thermal barrier between the consumer and the hot beverage. Preferably, the cup 43 includes a window portion that is alignable with the thermometer 41 and/or indicia. However, it is appreciated that the cup 44 may also include indicia for advertising or promotions. Preferably, a lid 29*a* having a sipping aperture and a vent threadably engages the top portion of the cup 44 to seal the beverage inside the container.

Figure 7B:
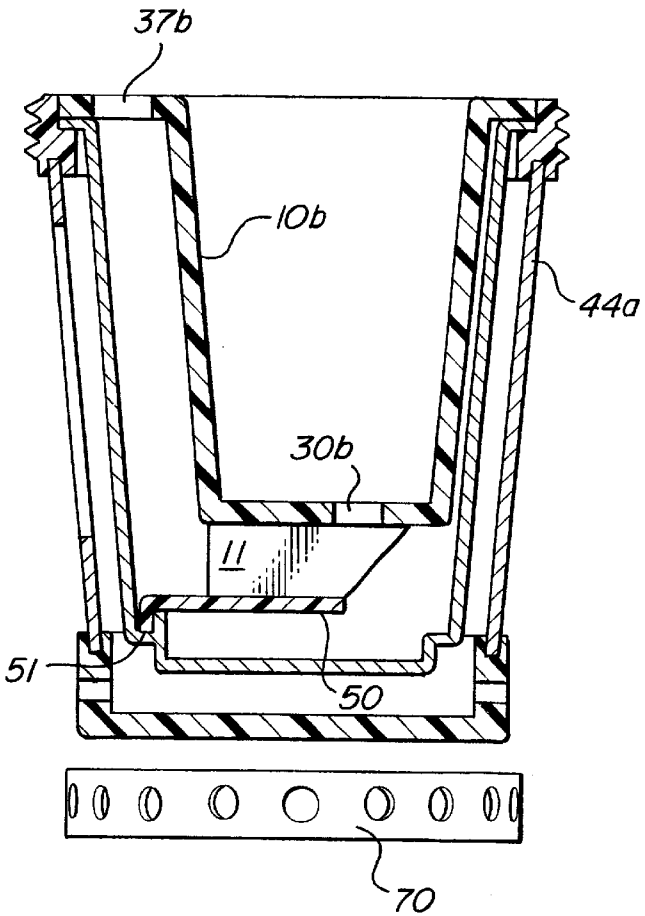
FIG. 7*b* is a cutaway view of the embodiment depicted in FIG. 7*a*.
Figure 7A:
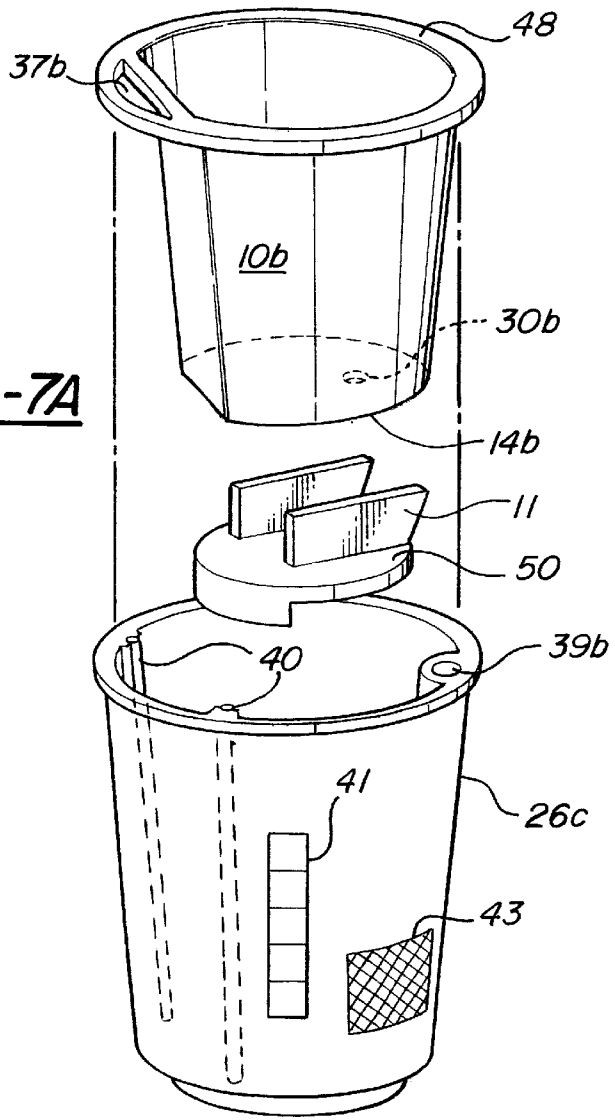
FIG. 7*a* is an exploded view of still another embodiment of the present invention.

Referring now to FIGS. 7*a* and *b*, there is shown a still further alternative embodiment of a container constructed in accordance with the present invention. A main chamber 10*b* is removably secured within a temperature moderating chamber 26*c*. An aperture 30*b* is defined in the main chamber 10*b* to allow fluid communication between the main chamber 10*b* and the moderating chamber 26*c*. Preferably, the main chamber includes a lip portion 48 having a sipping aperture 37*b*. As seen in FIGS. 7*a* and *b*, the lip portion 48 serves to enclose the moderating chamber 26*c*.

Still referring to FIGS. 7*a* and *b*, the base 14*b* of the main chamber 10*b* includes a support 11 extending downwardly from said base 14*b* and terminating at a flange member 50. The flange member 50 preferably cooperates with a groove portion 51 disposed on the interior of the moderating chamber 26*c* to assist with the support of the main chamber 10*b* within the moderating chamber 26*c*. A vent 39*b* is preferably defined within the chamber 26*c* to assist in cooling and pressure equalization. A pair of ribs 40 are preferably disposed on the interior of the chamber 26*c* that sealingly engage the exterior of the main chamber 10*b* to define a sipping passage aligned with the sipping aperture portion 37*b*. Furthermore, as discussed above, a thermometer 41 or logo 43 may be provided on the exterior of the chamber 26*c*.

The moderating chamber 26*c* with the main chamber 10*b* are preferably removably secured within a cup 44*a*. Preferably, the cup 44*a* includes a window to view the thermometer 41 and/or logo 43. A vent cap 70 is preferably provided on the base of the cup to assist in cooling the beverage within the container.

Referring now to FIGS. 8*a–c*, a lid 29*b* having o-rings 60 or similar sealing means is preferably threadably affixed to said cap 44 or 44*a*, to seal the container. Alternatively, as seen in FIG. 8*c*, the lid 29*c* may be removably snap-fit onto the cup 44 or 44*a*. A sipping aperture 67 communicates with sipping portion 37*a* or 37*b* to permit the consumer to consume their beverage. Additionally, a cooling vent 69 is provided to assist in cooling the main chamber 10*a* and pressure equalization. Altematively, a plurality of apertures 61 and 63 having slide valve assemblies 65 and 66 may be defined within the lid 29*b* to provide communication with the sipping portion 37*a* or 37*b* and the main chamber 10*a* or 10*b*.

While the present invention has been described in the context of a drinking vessel, it is appreciated that the present invention is readily fashioned into a serving pitcher. Embodiments of the present invention wherein the container serves as a pitcher have a sipping hole or temperature moderating chamber lip formed into a pouring spout.

The foregoing description is illustrative of particular embodiments of the invention, but is not meant to be a limitation upon the practice thereof The following claims, including all equivalents thereof, are intended to define the scope of the invention.

I claim:

1. A temperature-moderating beverage container comprising:

a main chamber having a main chamber top edge;

a temperature moderating chamber having a bottom and a wall defining a volume less than said main chamber and a temperature moderating chamber top edge, said moderating chamber defining an aperture in the bottom to provide fluid communication between said moderating chamber and the main chamber, wherein the main chamber top edge and the temperature moderating chamber top edge are coterminus; and a beverage transfer means associated with said aperture for selectively permitting the flow of beverage from said main chamber to said moderating chamber.

2. The container of claim 1 wherein said beverage transfer means comprises a valve assembly.

3. The container of claim 2 wherein said valve assembly further comprises a valve and a button for selectively activating said valve.

4. The container of claim 1 wherein said moderating chamber is formed integrally with a wall of said main chamber.

5. The container of claim 4 wherein said moderating chamber comprises a generally tubular member.

6. The container of claim 1 further comprising a lid removably secured to a wall of said container.

7. The container of claim 6 wherein said lid further comprises a sipping hole and a vent.

8. The container of claim 1 wherein said main chamber comprises a base having an interior and a exterior, a mounting fixture affixed to said base and a holder removably secured to said fixture.

9. A temperature moderating beverage container comprising:

a main chamber having a main chamber volume;

a temperature moderating chamber surrounding said main chamber and in fluid communication with said main chamber by an aperture, wherein said moderating chamber defines a volume less than said main chamber volume;

an object associated with the exterior surface of said temperature moderating chamber selected from the group consisting of: a thermometer, a logo and indicia; and an insulating cup having an exterior and a top portion, said cup adapted to receive therein said main chamber and said temperature moderating chamber, said cup having a window positioned such that said object is visible on the exterior of said cup.

10. The container of claim 9 wherein said object is a strip thermometer.

11. The container of claim 9 further comprising a lid having a sipping aperture and a vent, said lid threadably engaging the top portion of said cup.

* * * * *

UNITED STATES PATENT AND TRADEMARK OFFICE

CERTIFICATE OF CORRECTION

PATENT NO. : 6,471,085 B1
DATED : October 29, 2002
INVENTOR(S) : Gallo

It is certified that error appears in the above-identified patent and that said Letters Patent is hereby corrected as shown below:

Column 2,
Line 23, replace “resent” with -- present --.

Column 3,
Line 44, replace “wit” with -- with --.
Line 49, replace “main 10a” with -- main chamber 10a --.

Column 4,
Line 9, replace “cup 43” with -- cup 44 --.
Line 49, replace “cap 44” with -- cup 44 --.
Line 51, replace “cup 43” with -- cup 44 --.

Column 5,
Line 1, replace “thereof” with -- thereof --.

Signed and Sealed this

Fifteenth Day of April, 2003

JAMES E. ROGAN
*Director of the United States Patent and Trademark Office*